US011821606B2

(12) United States Patent
Collins et al.

(10) Patent No.: US 11,821,606 B2
(45) Date of Patent: Nov. 21, 2023

(54) LIGHT FIXTURE WITH INTEGRATED BACKUP POWER SUPPLY

(71) Applicant: ABL IP Holding LLC, Atlanta, GA (US)

(72) Inventors: Kerry S. Collins, Conyers, GA (US); Douglas D. Grove, Grayson, GA (US); Qirong Cao, Arlington Heights, IL (US)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 17/490,100

(22) Filed: Sep. 30, 2021

(65) Prior Publication Data

US 2023/0100443 A1 Mar. 30, 2023

(51) Int. Cl.

| | |
|---|---|
| ***F21S 9/02*** | (2006.01) |
| ***F21V 23/00*** | (2015.01) |
| ***F21S 8/02*** | (2006.01) |
| *F21Y 115/10* | (2016.01) |

(52) U.S. Cl.
CPC ..... *F21S 9/022* (2013.01); *F21S 8/026* (2013.01); *F21V 23/009* (2013.01); *F21Y 2115/10* (2016.08)

(58) Field of Classification Search
CPC ..... F21V 23/009; F21S 9/022; F21S 8/026
See application file for complete search history.

(56) References Cited

U.S. PATENT DOCUMENTS 8,360,620 B1 * 1/2013 Rashidi ..... F21S 9/022 362/217.1
10,711,983 B1 * 7/2020 Jeswani ..... F21S 8/026
(Continued)

FOREIGN PATENT DOCUMENTS

CN 107289406 A 10/2017
CN 207922021 U 9/2018

OTHER PUBLICATIONS

"BeveLED® 2.2 Cylinder Downlight—CBRD10", USAI, Llc, Available Online at: https://www.usailighting.com/site/download.php?id=18719, 2019, 7 pages.

(Continued)

*Primary Examiner* — Christopher E Dunay
(74) *Attorney, Agent, or Firm* — Kilpatrick Townsend & Stockton LLP

(57) ABSTRACT

A light fixture may include a light fixture housing defining an internal cavity. A light fixture may also include one or more light engines positioned within the internal cavity of the light fixture housing and designed to emit light for illumination. A light fixture may also include an external power driver positioned within the internal cavity of the light fixture housing and designed to receive power from an external power source, and provide power to and control the one or more light engines. A light fixture may also include a backup power supply positioned within the internal cavity of the light fixture housing, and a backup power driver positioned within the internal cavity of the light fixture housing and designed to receive power from the backup power supply, and provide power to and control the one or more light engines.

26 Claims, 8 Drawing Sheets

(56) References Cited

U.S. PATENT DOCUMENTS

| | | | | |
|---|---|---|---|---|
| 2005/0276047 | A1* | 12/2005 | Barozzini | F21S 9/022 362/249.12 |
| 2011/0075414 | A1* | 3/2011 | Van De Ven | F21V 29/773 362/249.02 |
| 2012/0155077 | A1 | 6/2012 | Kim et al. | |
| 2012/0212945 | A1 | 8/2012 | Frank | |
| 2017/0343185 | A1 | 11/2017 | Fieberg et al. | |
| 2018/0128436 | A1 | 5/2018 | Shaw | |
| 2018/0320882 | A1 | 11/2018 | Jenson et al. | |
| 2019/0101257 | A1 | 4/2019 | Boulanger et al. | |
| 2019/0203924 | A1 | 7/2019 | Devappa et al. | |
| 2019/0316745 | A1* | 10/2019 | Dalby | F21V 17/164 |
| 2021/0310641 | A1 | 10/2021 | Grider et al. | |
| 2022/0065440 | A1* | 3/2022 | Small | G08B 5/36 |
| 2022/0154898 | A1* | 5/2022 | Lokhande | F21S 9/024 |

OTHER PUBLICATIONS

"Bruck: A25 4" Round Hyperbolic Cylinder", Ledra Brands Inc., Available Online at: https://brucklighting.com/download/b/A25%20Hyperbolic%20Cylinder/Spec%20Sheets/A25%20Hyperbolic%20Cylinder%20Spec%20Sheet.pdf, 2 pages.

"EVO 4" LED Round Pendant Stem Cylinder", Gotham Lighting, Available Online at: https://www.acuitybrands.com/products/detail/991105/gotham-lighting/evo4pc-cylinder/evo-4-led-round-pendant-stem-cylinder, 1 page.

"PCL08: 8" Architectural Cylinder LED Downlight", NICOR, Inc., Available Online at: https://nicorlighting.com/spec-sheets/PCL_SS.pdf, Mar. 11, 2019, 2 pages.

"Spectrum Lighting", Spectrum Lighting, Inc., Available Online at: https://www.speclight.com/c19/Cylinders.htm, Accessed from Internet on Jan. 20, 2022, 15 pages.

* cited by examiner

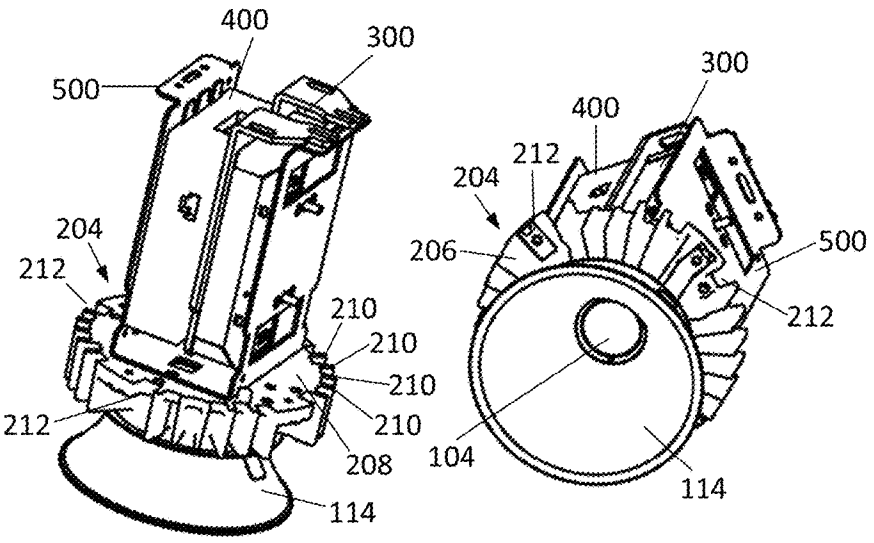
Fig. 2A
Fig. 2B
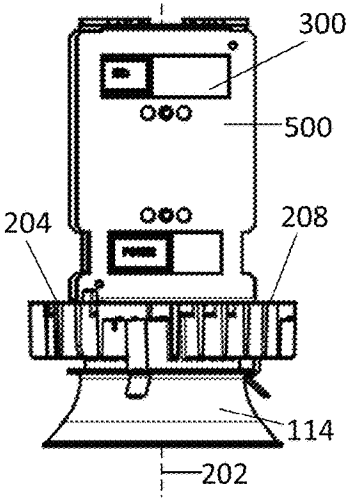
Fig. 2C
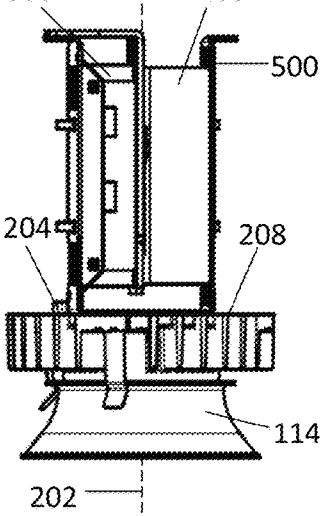
Fig. 2D

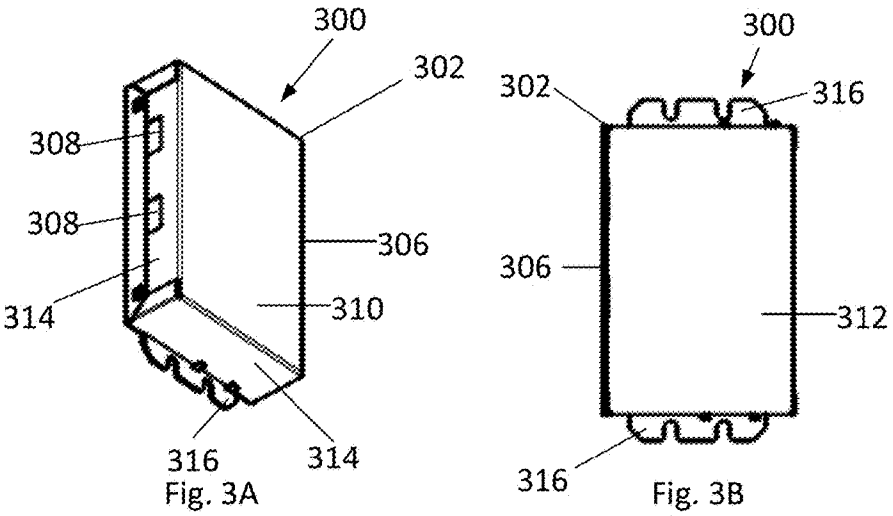
Fig. 3A
Fig. 3B
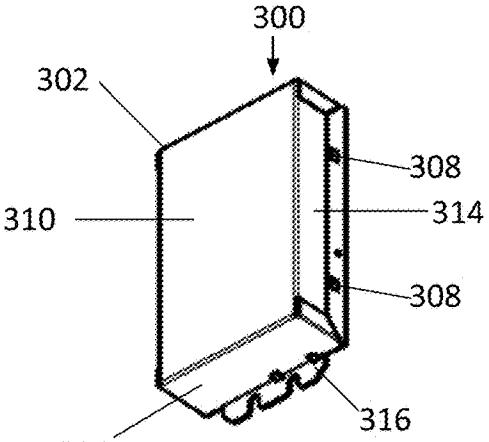
Fig. 3C

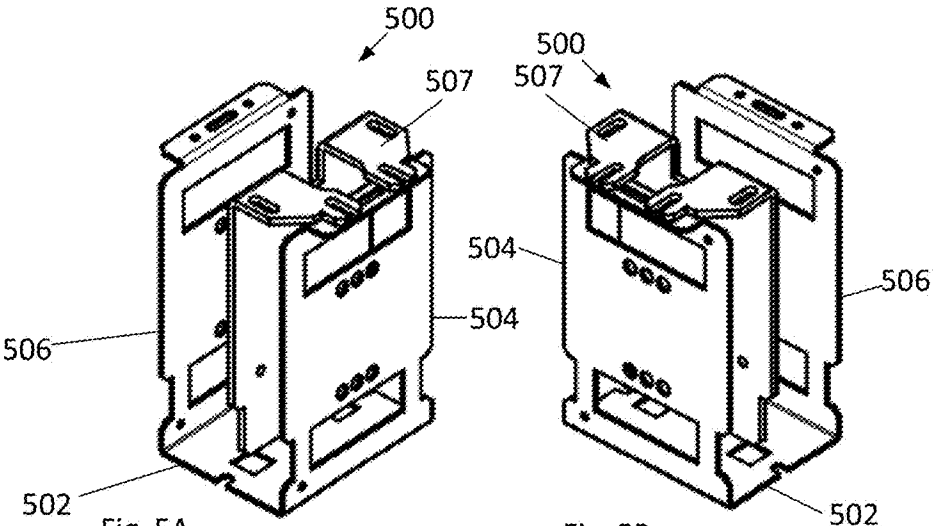
Fig. 5A
Fig. 5B
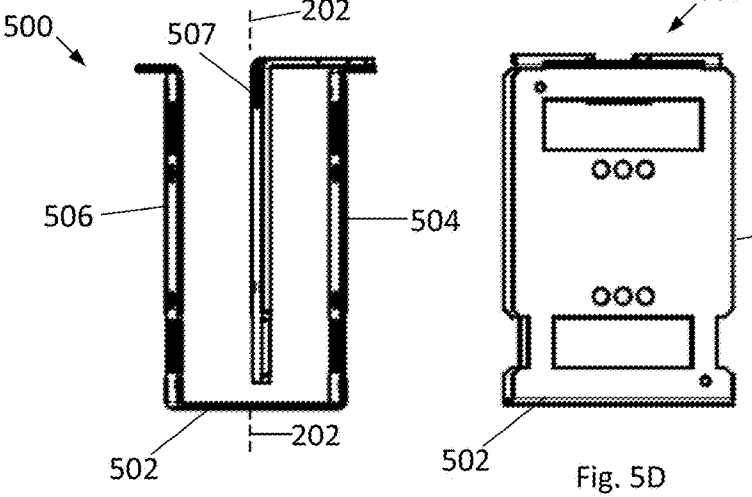
Fig. 5C
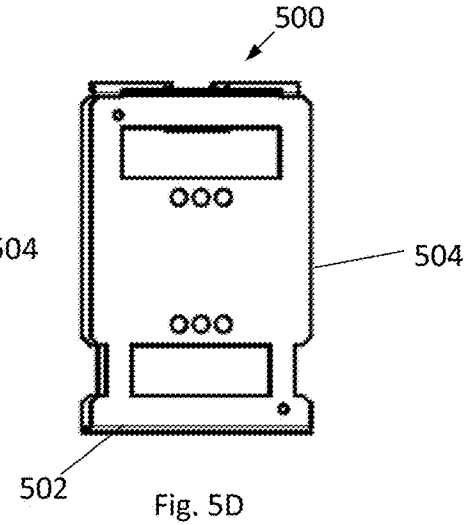
Fig. 5D

LIGHT FIXTURE WITH INTEGRATED BACKUP POWER SUPPLY

FIELD OF THE INVENTION

The present technology relates to light fixtures including a light engine connected to both an external power driver and a backup power driver, e.g. a battery powered driver.

BACKGROUND

Providing illumination during power outages is beneficial to the occupants of illuminated spaces, particularly indoor spaces occupied by many people, for example, office buildings, factories, hospitals, nursing homes and schools. One way of providing illumination during power outages is to provide illumination from light fixtures not relying on an external power supply. Existing light fixtures able to provide illumination during power outages are connected to external backup power supplies with dedicated backup wiring internal to the building between the light fixture and the location within the building where the backup power supply is located, which adds additional costs and labor during new construction installations, as well as retrofitting a building with existing light fixtures able to provide illumination during power outages. Accordingly, there is a need for light fixtures able to provide illumination during power outages without dedicated backup wiring internal to the building.

SUMMARY

The terms "invention," "the invention," "this invention", the "present technology" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

The present technology includes light fixtures including light fixture housings defining internal cavities. A light fixture may also include one or more light engines positioned within the internal cavity of the light fixture housing and designed to emit light for illumination. A light fixture may also include an external power driver positioned within the internal cavity of the light fixture housing and designed to receive power from an external power source, and provide power to and control the one or more light engines. A light fixture may also include a backup power supply positioned within the internal cavity of the light fixture housing, and a backup power driver positioned within the internal cavity of the light fixture housing and designed to receive power from the backup power supply, and provide power to and control the one or more light engines.

In some embodiments, the external power driver and the backup power driver may be designed so that, when the external power source is functioning, the light fixture operates in a normal operation mode with the external power driver providing power to and controlling the one or more light engines, and, when the external power source is not functioning, the light fixture operates in an emergency operation mode with the backup power driver providing power to and controlling the one or more light engines. In some embodiments, the external power source may be power from an electrical grid. In some embodiments, the backup power driver is designed to power and control the one or more light engines to emit a lower intensity illumination in the emergency operation mode relative to an intensity of illumination in the normal operation mode. In some embodiments, the one or more light engines include a plurality of light engine and in the emergency operation mode a subset of the plurality of light engines operated in the normal operation mode are operated in order to achieve the lower intensity of illumination. In some embodiments, the backup power driver is designed to power and control the one or more light engines to emit, in the emergency operation mode, light of a different color to a color of light emitted in the normal operation mode.

In some embodiments, the backup power supply is a battery. In some embodiments, a light fixture may also include a first driver housing. The external power driver may be positioned within the first driver housing. In some embodiments, a light fixture may also include a second driver housing. The backup power driver may positioned within the second driver housing. In some embodiments, a light fixture may also include a bracket, and the first driver housing and the second driver housing may be coupled to the bracket. The first driver housing, the second driver housing and the bracket may be positioned entirely within the internal cavity of the light fixture housing.

In some embodiments, the backup power supply is a battery, and the battery may be positioned within the second driver housing. In some embodiments, the bracket is U-shaped and includes a bottom side, a first lateral side, and a second lateral side. The first driver housing may be coupled to the first lateral side and the second driver housing may be coupled to the second lateral side. The light fixture housing may be cylindrical and defines a longitudinal axis. The first driver housing and the second driver housing are positioned on opposite sides of the longitudinal axis. The first driver housing and the second driver housing may be positioned at distances on the opposite sides of the longitudinal axis such that moments perpendicular to the longitudinal axis generated by the first driver housing and the second driver housing are equal. The first driver housing and the second driver housing may be rectangular prism in shape. The light fixture may be a pendant light fixture configured for the cylindrical light fixture housing to be suspended from a ceiling of a building so that the external power driver, backup power driver, backup power supply, and one or more light engines are positioned below the ceiling. The light fixture further may also include a light engine assembly comprising a body and the one or more light engines. The bracket may be coupled to the body and the body may be coupled to the light fixture housing in order to couple the first driver housing and the second driver housing to the light fixture housing. The body may define a plurality of cooling fins extending radially around the longitudinal axis, and the bracket may be thermally coupled to the body in order for the plurality of cooling fins to dissipate heat generated by the external power driver and the backup power driver. The light fixture housing may define a plurality of ribs extending parallel to the longitudinal axis within the internal cavity of the light fixture housing, the body may define a plurality of slots, and the plurality of ribs may be positioned within the plurality of slots in order to couple the body to the light fixture housing.

In some embodiments, a light fixture also includes wiring for connecting the external power driver and the backup power driver to the external power source. In some embodiments, a light fixture also includes control wiring configured for connecting an external lighting control system to the external power driver in order for the external power to control the one or more light engines. The external power driver and the backup power may only be connected externally to the external power source and the external lighting control system.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

FIGS. 2A-2D show views of a light fixture with the outer light fixture housing removed, according to embodiments of the present technology.

FIGS. 3A-3C show views of an external power driver assembly, according to embodiments of the present technology.

FIGS. 5A-5D show views of a driver bracket, according to embodiments of the present technology.

DETAILED DESCRIPTION

Figure 1C:
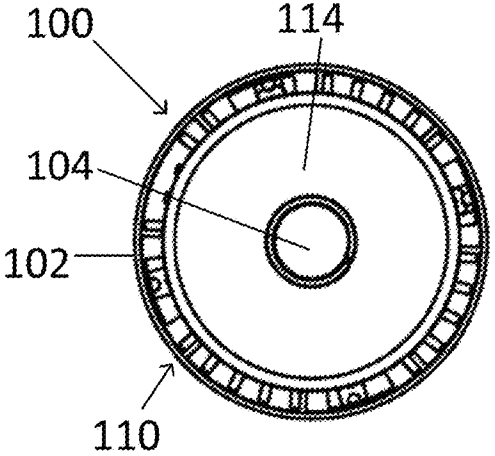
FIGS. 1A-1D show views of a light fixture, according to embodiments of the present technology.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the figure (or figures) to which the components and directions are referencing.

The present technology relates to light fixtures 100 including one or more light engines 104 which may selectively receive power originating from either an external power source or a backup power source. The light fixture 100 may include an external power driver 304, also referred to as a primary driver or first driver, for driving the one or more light engines 104 and powered by the external power source 1100 (see FIG. 11). The light fixture 100 also includes a backup power driver 404, also referred to as a secondary driver or second driver, for driving the one or more light engines 104 and powered by a backup power supply, for example a battery 405, within the light fixture 100, wherein the backup power driver 404 may receive power from the external power source 1000. In some embodiments, the backup power supply may comprise a capacitor.

With the backup power driver 404 and battery 405 within the light fixture 100, the light fixture 100 may receive power and control signals from standard wiring used with typical light fixtures. This is beneficial compared to existing backup power systems for light fixtures wherein the backup power supply is located remotely from the light fixture, e.g. within the ceiling, and therefore requires backup power wiring extending through the building to the light fixture.

Figure 1D:
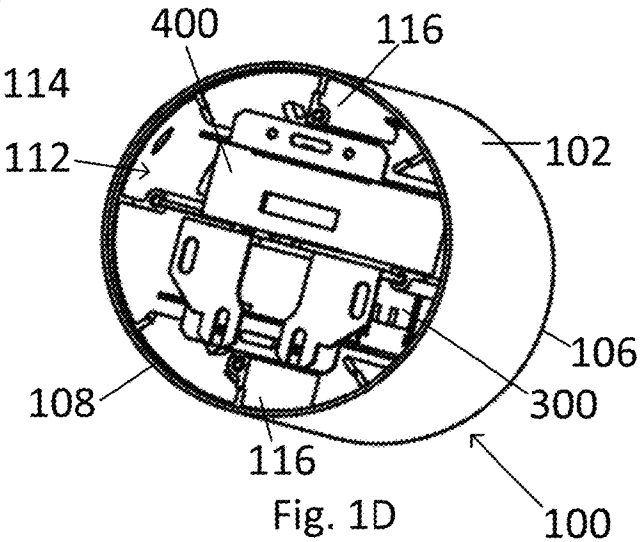
Figure 1B:
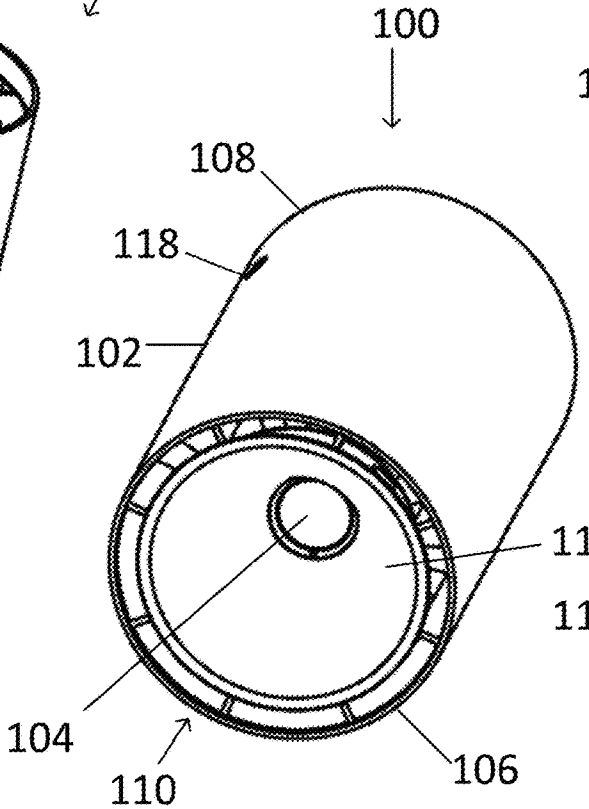
Figure 1A:
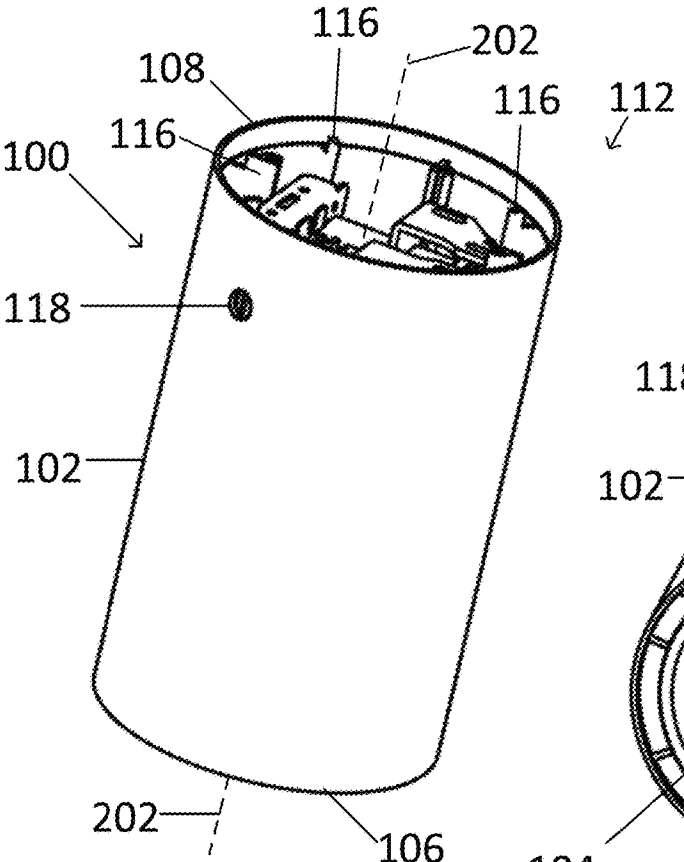

FIGS. 1A and 1B show perspective views of a light fixture 100. As shown, a light fixture 100 may include a housing 102 (also referred to as a light fixture housing), and one or more light engines 104 within the housing 102 and proximate to a bottom end 106 of the housing 102. The light fixture 100 may further include an external power driver assembly 300 and a backup power driver assembly 400 within the housing 102 and positioned between the one or more light engines 104 and a top end 108 of the housing 102, opposite the bottom end 106.

The housing 102 may define an internal cavity. The housing 102 may also define a bottom opening 110 at the bottom end 106, through which light emitted from the one or more light engines 104 is emitted. In some embodiments, for example as shown in FIGS. 1A-1D, the housing 102 may be cylindrical with cylindrical sidewalls, wherein the bottom opening 110 is circular, as shown in FIG. 1C. In some embodiments, the housing 102 may be shaped other than cylindrical, for example a rectangular prism. The housing 102 may be formed from materials, including but not limited to, metal and plastic.

The housing 102 may also define a top opening 112 at the top end 108. The top opening 112 may allow for removal of the external power driver assembly 300 and the backup power driver assembly 400 from the housing 102, for example for repair or replacement purposes. In some embodiments, for example, as shown in FIGS. 1A and 1D, the top opening 112 is circular. The top opening 112 may be shaped and sized to allow for the external power driver assembly 300 and the backup power driver assembly 400 to be separately removed from the housing 102.

The one or more light engines 104 may include, but are not limited to incandescent, compact fluorescent (CFL), halogen, and light-emitting diode (LED). For example, in some embodiments, the one or more light engines 104 may comprise one or more PCBs populated with LEDs for generating and emitting light, or may be chip-on-board LEDs. As will be discussed in greater detail below, the one or more light engines 104 may be driven, e.g. receive power and/or control signals, from drivers in the external power driver assembly 300 and from drivers in the backup power driver assembly 400. In some embodiments, the LEDs may be various types of LEDs including single-die LEDs, multi-die LEDs, direct current (DC) LEDs, alternating current (AC) LEDs, organic light emitting diodes, and/or various other suitable LEDs. White, color, or multicolor LEDs may be used. Moreover, the LEDs need not all be the same color and/or type; rather, mixtures of different colors and/or types of LEDs may be used. As will be discussed in greater detail below, the one or more light engines 104 may be driven differently, e.g. different intensities and/colors, by drivers of the external power driver assembly 300 and drivers of the backup power driver assembly 400.

The housing 102 of the light fixture 100 may also house other components, in addition to the one or more light engines 104, the external power driver assembly 300 and the backup power driver assembly 400, including, but limited to, sensors, processors and communication modules (e.g. wired and/or wireless). The components positioned within the housing 102, including the one or more light engines 104, the external power driver assembly 300 and the backup power driver assembly 400, may be thermally coupled to the housing 102 in order for heat generated by the components to be dissipated by the housing 102.

As shown in FIGS. 1B and 1C, the light fixture 100 may further include a reflector 114 positioned within the housing 102 proximate to the bottom end 106. The reflector 114 may be shaped and sized to span across the bottom opening 110 of the housing 102. As shown in the bottom view of FIG. 1C, the reflector 114 may define an opening that substantially corresponds in shape and size of the one or more light engines 104. The reflector 114 may be conical, as shown in FIGS. 2C and 2D, and the opening of the reflector 114 may allow for light emitted from the one or more light engines 104 to be emitted downwardly out of the light fixture 100. Light emitted from the one or more light engines 104 may be reflected and focused by an internal surface of the reflector 114.

FIGS. 2A-2D show the light fixture 100 of FIGS. 1A-1D with the housing 102 removed in order to show the internal components mounted within the housing 102. As shown, the components, including the one or more light engines 104, the external power driver assembly 300 and the backup power driver assembly 400, within the housing 102 are positioned along a longitudinal axis 202 of the light fixture 100, extending in a direction between the bottom end 106 and the top end 108.

As shown in FIGS. 2A-2D, the light engine 104 may be included in a light engine assembly 204. The light engine assembly 204 may include a body 206 to which the one or more light engines 104 are coupled. The body 206 may define a top surface 208 facing the external power driver assembly 300 and the backup power driver assembly 400. The body 206 may be formed of metal, for example cast and/or machined aluminum. The body 206 may define cooling fins 210 extending radially around the longitudinal axis 202. The cooling fins 210 of the body 206 may dissipate heat generated by the one or more light engines 104, as well as heat generated by the external power driver assembly 300 and heat generated by the backup power driver assembly 400, which may be coupled to the top surface 208 of the body 206 with a bracket 500, as shown in FIGS. 2A-2D. In some embodiments, the light fixture 100 may include one or more heatsinks coupled to the bracket 500. For example, the light fixture may include a first heatsink coupled to the bracket 500 adjacent the external power driver assembly 300 and a second heatsink coupled to the bracket 500 adjacent the backup power driver assembly 400. The heatsinks may include a flat proximal end coupled to the bracket 500, and a curved distal end defined by cooling fins coupled to the internal cylindrical sidewall of the housing 102.

In some embodiments, the light engine assembly 204 may be directly coupled to the housing 102. For example, as shown in FIG. 1A, internal surfaces of the housing 102 may include inwardly facing ribs 116. The ribs 116 may extend parallel to the longitudinal axis 202. The ribs 116 may be received within slots 212 defined in the body 206, as show for example, in FIGS. 2A and 2B. The ribs 116 may be secured within the slots 212 with fasteners extended through threaded holes in the body 206. In some embodiments, the reflector 114 may be directly coupled to the housing 102 and/or to the light engine assembly 204.

Figure 11:
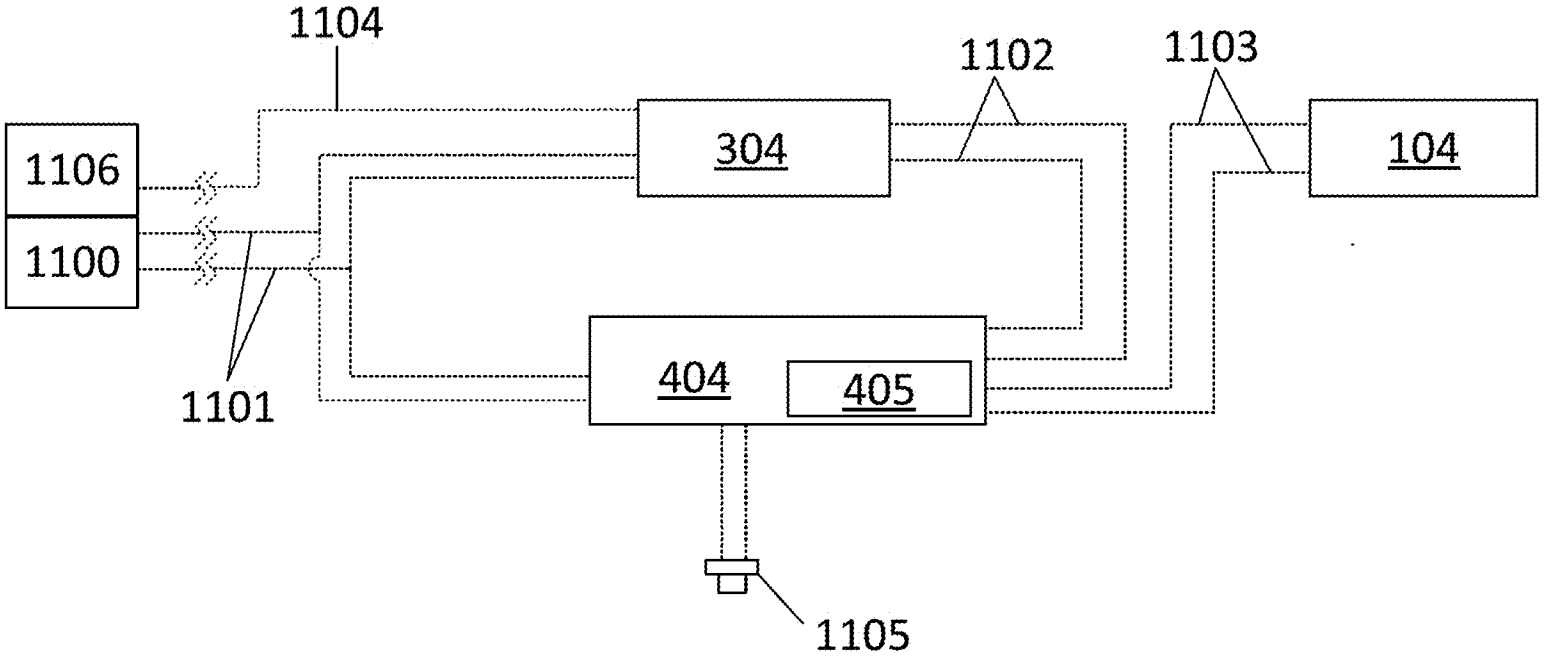
FIG. 11 shows a wiring diagram of a light fixture, according to embodiments of the present technology.

FIGS. 3A-3C show an embodiment of an external power driver assembly 300. The external power driver assembly 300 includes a housing 302, also referred to as a first driver housing, for encasing an external power driver 304. The external power driver 304 includes circuitry for receiving external power. The external power may be from a steady source providing consistent power. In some embodiments, the external power source is an alternating current power source such as an electrical grid (e.g. 120 V and 60 Hz AC electricity). In some embodiments, the external power source may be a battery and/or a generator remote from the light fixture 100, for example located within a wall or ceiling of the building. The external power driver 304 further includes circuitry for converting the received power into a drive signal for driving the one or more light engines 104 coupled to the external power driver 304. The external power driver 304 may also be connected to devices for controlling the one or more light engines 104, e.g. switches or a lighting control system 1106 (see. FIG. 11).

The housing 302 of the external power driver assembly 300 may include a central portion 306 which may be shaped as a rectangular prism. The central portion 306 may define an internal cavity housing the external power driver 304. The central portion 306 may define openings 308 allowing for physical and/or visual access to connectors and displays/indicator lights on the circuitry associated with the external power driver 304. For example, the openings 308 may provide access wiring coupled to an external power source, and wiring for connecting the external power driver 304 to the one or more light engines 104.

The central portion 306 may have a rectangular prism shape comprising a top surface 310 opposing a bottom surface 312, and sidewalls 314 connecting the top surface 310 to the bottom surface 312. The top surface 310 and the bottom surface 312 may be generally the same size and be larger than each of the sidewalls 314 so that the central portion 306 is a generally flat rectangular prism, e.g. similar in aspect ratio to a textbook or VHS cassette.

The housing 302 may further comprise two mounting flanges 316. The mounting flanges 316 may be rectangular. Each mounting flange 316 may be coplanar with the bottom surface 312 and extend away from opposite ends of the central portion 306, as shown in FIGS. 3A-3C. The mounting flanges 316 may be positioned and/or secured to the bracket 500 in order to couple the external power driver assembly 300 to the bracket 500. As will be discussed in greater detail below, the external power driver assembly 300 may be positioned within the housing 102 and coupled to the bracket 500 so that the top surface 310 faces the longitudinal axis 202, as shown in FIG. 2D.

Figure 4A:
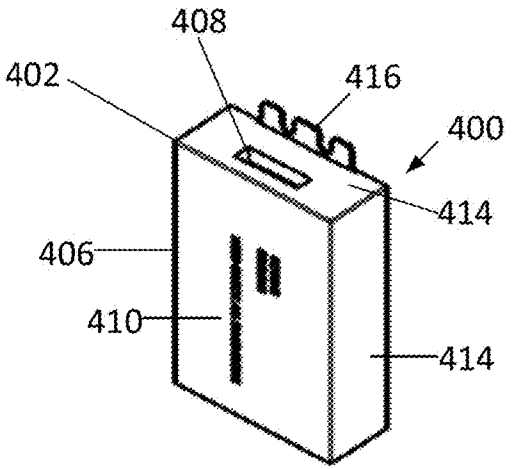
FIGS. 4A-4C shows views of a backup power driver assembly, according to embodiments of the present technology.
Figure 4C:
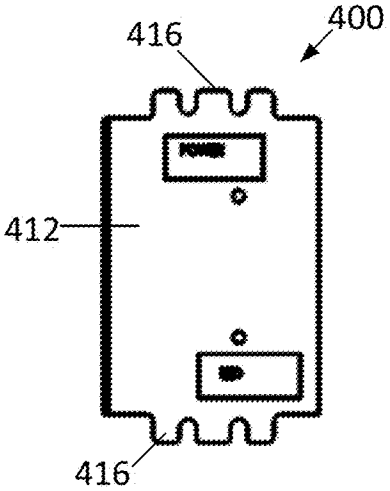
Figure 4B:
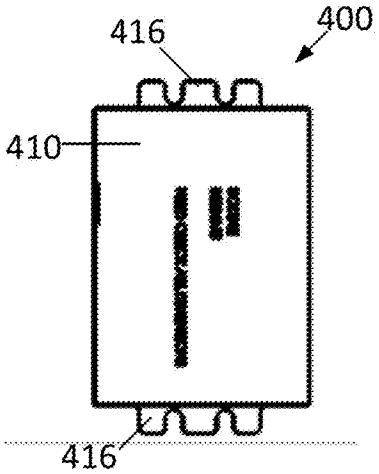

FIGS. 4A-4C show an embodiment of a backup power driver assembly 400. The backup power driver assembly 400 includes a housing 402, also referred to as a second driver housing, for encasing a backup power driver 404. The backup power driver 404 includes circuitry for receiving power from an external source. The external source may be AC or DC, for example building power from the grid (e.g. 120 V and 60 Hz AC electricity) or power from the external power driver 304. The backup power driver 404 further includes circuitry for charging a power storage unit, e.g. a battery 405, using the power received by the external source. The backup power driver 404 further includes circuitry for converting the stored power into a drive signal for driving the one or more light engines 104 coupled to the backup power driver 404. The backup power driver 404 may also be connected to devices for controlling the one or more light engines 104, e.g. switches or lighting control systems.

The housing 402 of the backup power driver assembly 400 may include a central portion 406, which may be shaped as a rectangular prism. The central portion 406 may define an internal cavity housing the backup power driver 404 and battery 405, shown in FIG. 11. The central portion 406 may define openings 408 allowing for physical and/or visual access to connectors and displays/indicator lights on the circuitry associated with the backup power driver 404. For example, the openings 408 may provide access wiring coupled to an external power source, and wiring for connecting the external power driver 304 to the one or more light engines 104.

The central portion 406 may have a rectangular prism shape comprising a top surface 410 opposing a bottom surface 412, and sidewalls 414 connecting the top surface 410 to the bottom surface 412. The top surface 410 and the bottom surface 412 may be generally the same size and be larger than each of the sidewalls 414 so that the central portion 406 is a generally flat rectangular prism, e.g. similar in aspect ratio to a textbook or VHS cassette.

The housing 402 may further comprise two mounting flanges 416. The mounting flanges 416 may be rectangular. The mounting flanges 416 may be coplanar with the bottom surface 412 and extend away from opposite ends of the central portion 406, as shown in FIGS. 4A-4C. The mounting flanges 416 may be positioned and/or secured to the bracket 500 in order to couple the backup power driver assembly 400 to the bracket 500. As will be discussed in greater detail below, the backup power driver assembly 400 may be positioned within the housing 102 and coupled to the bracket 500 so that the top surface 410 faces the longitudinal axis 202, as shown in FIG. 2D.

The circuitry of the external power driver 304 and the backup power driver 404 allow for the one or more light engines 104 to be driven by the external power driver 304 when the external power source is functioning, for example when there is not a power outage. Further, the circuitry of the external power driver 304 and the backup power driver 404 allow for the battery 405 to be charged when the external power source is functioning. When the external power source is not functioning, for example during a power outage, the circuitry of the external power driver 304 and the backup power driver 404 cause the one or more light engines 104 to be driven by the backup power driver 404 with power supplied by the battery 405. Accordingly, the one or more light engines 104 of the light fixture 100 can be used during normal operation for normal illumination and can also be used as emergency illumination during power outages, for example to allow occupants of a space to have illumination to exit the space upon the loss of power from the external power source. The circuitry of the external power driver 304 and the backup power driver 404 may automatically transition from normal operation to emergency operation in response to a loss of external power and/or in response to receiving a signal indicative of a loss of power from the external power source.

In some embodiments, the backup power driver 404 may be programmed to drive the one or more light engines 104 at a lower intensity than the external power driver 304, for example a minimum illumination level needed to guide occupants of the space to an exit. In some embodiments, the backup power driver 404 may be programmed to drive only a subset of the one or more light engines 104. Driving the one or more light engines 104 with a lower intensity and/or driving a subset of the one or more light engines 104 is beneficial in extending the duration the battery 405 is able to drive the one or more light engines while providing emergency illumination.

Figure 6B:
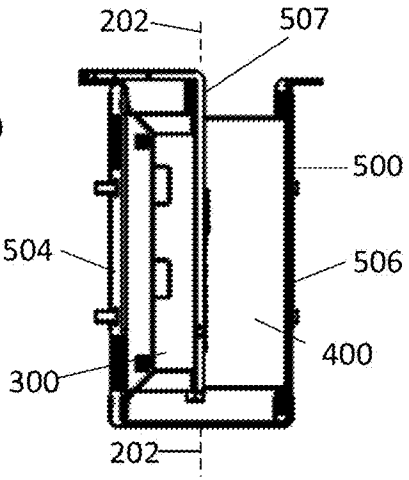
FIGS. 6A and 6B show views of an assembly of the external power driver assembly, the backup power driver assembly, and the driver bracket, according to embodiments of the present technology.

FIGS. 5A-5D show an embodiment of a bracket 500. As noted above, the bracket 500 may be coupled to the light engine assembly 204, and the external power driver assembly 300 and backup power driver assembly 400 may each be coupled to the bracket 500. In some embodiments, the bracket 500 may be generally U-shaped and include a bottom side 502, and two lateral sides 504 and 506. As shown in FIG. 5C, the bottom side 502 may be generally flat and each of the two lateral sides 504 and 506 may extend perpendicularly from the bottom side 502. In some embodiments, the bracket 500 may be coupled to a second bracket 507, for example as shown in FIGS. 5A-5C. The second bracket 507 may be L-shaped. As shown in FIG. 6B, the second bracket 507 may be coupled to the bracket 500 so that the second bracket 507 is positioned between and coupled to the external power driver assembly 300 and backup power driver assembly 400.

Figure 6A:
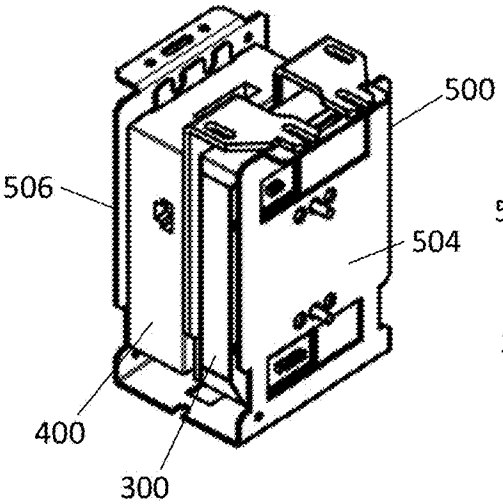
Figure 7B:
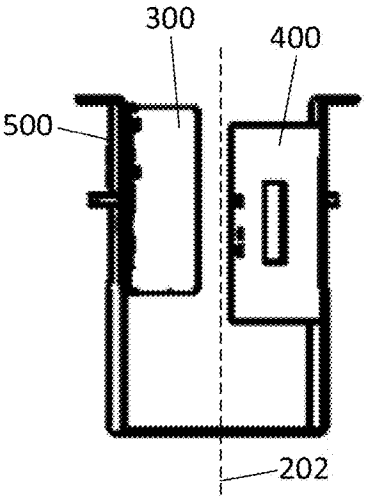
FIGS. 7A and 7B show views of an assembly of the external power driver assembly, the backup power driver assembly, and the driver bracket, according to embodiments of the present technology.
Figure 7A:
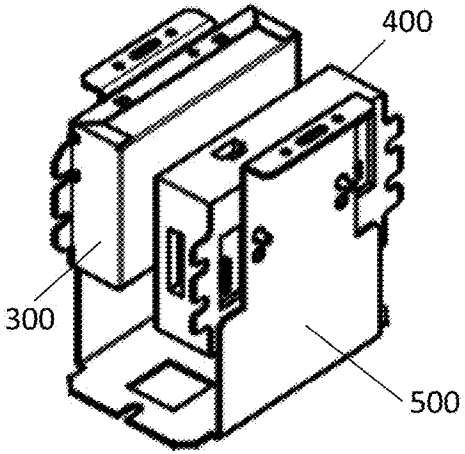

As shown in FIGS. 6A and 6B, and FIGS. 7A and 7B, the external power driver assembly 300 may be coupled to an inwardly facing surface of lateral side 504, and the backup power driver assembly 400 may be coupled to an inwardly facing surface of lateral side 506. In some embodiments, for example as shown in FIGS. 6A and 6B, the external power driver assembly 300 and the backup power driver assembly 400 may be oriented with the long dimensions parallel to the longitudinal axis 202, or in some embodiments, for example as shown in FIGS. 7A and 7B, the external power driver assembly 300 and the backup power driver assembly 400 may be oriented with their long dimension perpendicular to the longitudinal axis 202. The orientation of the external power driver assembly 300 and the backup power driver assembly 400 may be based on the size and shape of the housing 102.

As noted above and shown in FIGS. 6A, 6B, 7A, and 7B, the external power driver assembly 300 and the backup power driver assembly 400 may be positioned on opposite sides of the longitudinal axis 202. This positioning is beneficial in allowing both the external power driver assembly 300 and the backup power driver assembly 400 to fit within the housing 102 without the housing 102 having to be elongated, since the backup power driver assembly 400 occupies substantially the same distance along the longitudinal axis 202 as the external power driver assembly 300. In other words, the housing 102 is substantially the same size and has a substantially similar outward appearance as a housing for a light fixture with only an external power driver assembly 300, and not a backup power driver assembly 400.

The bracket 500 may be sized and shaped so that moments created by the external power driver assembly 300 and the backup power driver assembly 400 on either side of the longitudinal axis 202 are equal so that the center of gravity of the assembly of the bracket 500, the external power driver assembly 300 and the backup power driver assembly 400 is coincident with the longitudinal axis 202 of the light fixture 100, as shown in FIGS. 2A-2D. This balance is beneficial, for example, in pendant lighting so that the light fixture 100 hangs vertically without stressing the mounting hardware due to an unbalanced or unevenly weighted fixture.

In some embodiments, the bracket 500 may be formed from a single piece of sheet metal. As shown in FIGS. 2A-2D, the bracket 500 may be coupled to the top surface 208 of the body 206. Brackets 500 formed of metal are beneficial in transferring heat generated by the external power driver assembly 300 and the backup power driver assembly 400 to the body 206 in order to be dissipated by the cooling fins 210.

Figure 8:
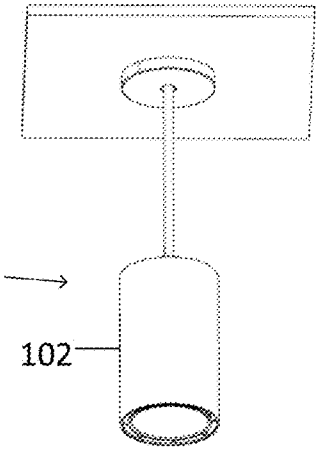
FIG. 8 shows a pendant light fixture, according to embodiments of the present technology.
Figure 9:
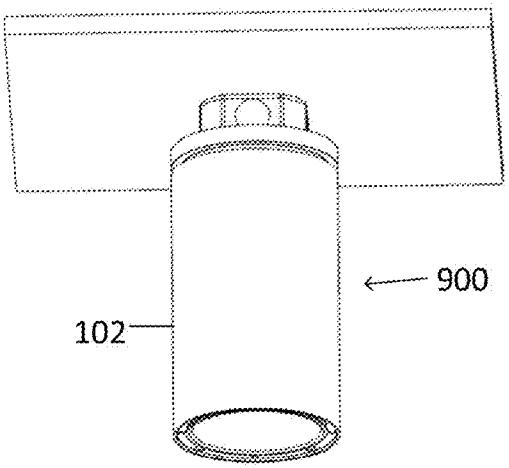
FIG. 9 shows a surface ceiling light fixture, according to embodiments of the present technology.
Figure 10:
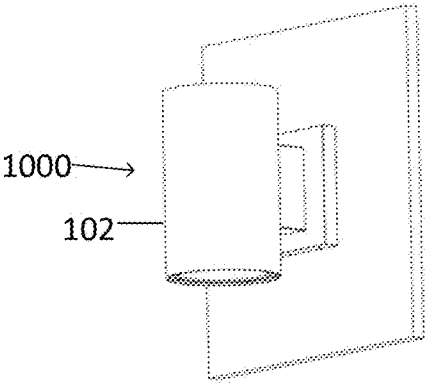
FIG. 10 shows a wall mounted light fixture, according to embodiments of the present technology.

In some embodiments, for example as shown in FIG. 1A-1D, the light fixture 100 may be of a type to be installed in a building external to a ceiling or wall, e.g. a pendant type light fixture 800 as shown in FIG. 8, a surface ceiling type light fixture 900 as shown in FIG. 9, or a wall mounted (e.g. sconce) type of light fixture 100 as shown in FIG. 10.

FIG. 11 shows a wiring diagram of a light fixture 100. As shown, and discussed above, a light fixture 100, may include one or more light engines 104, an external power driver 304, and a backup power driver 404. The backup power driver 404 may include circuitry for charging a battery 405. As shown in FIG. 11, external power source wiring 1101, providing power from an external power source 1100, may be connected to external power driver 304 and to the backup power driver 404. In some embodiments, the external power source wiring 1101, providing power from an external power source 1100, may be directly connected to only one of the external power driver 304 and the backup power driver 404, and the non-directly connected driver may receive external power from the directly connected driver.

As shown, the one or more light engines 104 may be connected to the backup power driver 404 with power wires 1103. Drive signals from both the external power driver 304 and the backup power driver 404 may be transmitted to the one or more light engines 104 through the power wires 1103. In some embodiments, separate sets of power wires 1103 may connect the external power driver 304 to the one or more light engines 104, and the backup power driver 404 to the one or more light engines 104.

In some embodiments, the external power driver 304 receives switched power and/or a control signal (e.g. dimmer signal) from switch or a lighting control system 1106 via the control line 1104. The first control wiring 1102 may transmit signals processed by the external power driver 304 to control the output to the one or more light engines 104. In some embodiments, the external power driver 304 may be connected to the backup power driver 404 with the first control wiring 1102. The first control wiring 1102 may transmit signals and/or power between the external power driver 304 and the backup power driver 404.

As shown in FIG. 11, the light fixture 100 may only be connected to an external power source 1100 via the external power source wiring 1101 and a lighting control system 1106 via the control line 1104, similar to a standard light fixture without a backup power supply. In other words, the light fixtures 100 as disclosed herein may not be connected to any external wiring associated with backup power. Accordingly, the light fixture 100 as disclosed herein may be installed similarly to a standard light fixture, while providing the benefit of a backup power supply entirely within the housing 102 of the light fixture 100. Further, the light fixtures 100, including a backup power supply, as disclosed herein do not require rewiring within the walls or ceiling of the building, which is beneficial in retrofitting buildings to have backup powered emergency lighting without a major renovation.

In some embodiments, a test button 1105 may be electrically coupled to the backup power driver 404. Actuation of the test button 1105 causes backup power driver 404 and the external power driver 304 to drive the one or more light engines 104 with power from the battery 405 in order to test the backup power driver 404 and the battery 405. The test button 1105 may be positioned within the housing 102 of the light fixture 100, which is beneficial for testing the light fixture 100 without the need to access wiring and circuitry positioned within the ceiling or wall of a building. In some embodiments, housing 102 may include openings 118 through which the test button 1105 is accessible, for example as shown in FIGS. 1A and 1B.

It will be appreciated that the shape, configuration, and components of the light fixture 100 should not be considered limiting on the present disclosure as the light fixture 100 may have any desired shape or configuration. The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

The invention claimed is:

1. A light fixture comprising:

a light fixture housing defining an internal cavity and a longitudinal axis, wherein at least one rib extends parallel to the longitudinal axis of the light fixture housing within the internal cavity of the light fixture housing;

a light engine assembly positioned within the internal cavity of the light fixture housing and comprising a body defining at least one slot and one or more light engines coupled to the body and configured to emit light for illumination;

an external power driver positioned within the internal cavity of the light fixture housing and configured to receive power from an external power source, and provide power to and control the one or more light engines;

a backup power supply positioned within the internal cavity of the light fixture housing; and a backup power driver positioned within the internal cavity of the light fixture housing and configured to receive power from the backup power supply, and provide power to and control the one or more light engines, wherein each of the external power driver and the backup power driver comprises a long dimension and wherein the long dimension of each of the external power driver and the backup power driver extends parallel to the longitudinal axis of the light fixture housing, and wherein the at least one rib is positioned within the at least one slot to couple the body the light fixture housing.

2. The light fixture of claim 1, wherein the external power driver and the backup power driver are configured so that, when the external power source is functioning, the light fixture operates in a normal operation mode with the external power driver providing power to and controlling the one or more light engines, and, when the external power source is not functioning, the light fixture operates in an emergency operation mode with the backup power driver providing power to and controlling the one or more light engines.

3. The light fixture of claim 2, wherein the external power source comprises power from an electrical grid.

4. The light fixture of claim 2, wherein the backup power driver is configured to power and control the one or more light engines to emit a lower intensity illumination in the emergency operation mode relative to an intensity of illumination in the normal operation mode.

5. The light fixture of claim 4, wherein the one or more light engines comprise a plurality of light engines, and wherein in the emergency operation mode a subset of the plurality of light engines operated in the normal operation mode are operated in order to achieve the lower intensity of illumination.

6. The light fixture of claim 2, wherein the backup power driver is configured to power and control the one or more light engines to emit, in the emergency operation mode, light of a different color to a color of light emitted in the normal operation mode.

7. The light fixture of claim 1, wherein the backup power supply is a battery.

8. The light fixture of claim 1, further comprising:

a first driver housing, wherein the external power driver is positioned within the first driver housing;

a second driver housing, wherein the backup power driver is positioned within the second driver housing; and a bracket, wherein the first driver housing and the second driver housing are coupled to the bracket, and wherein first driver housing, the second driver housing and the bracket are positioned entirely within the internal cavity of the light fixture housing.

9. The light fixture of claim 8, wherein the backup power supply is a battery, and wherein the battery is positioned within the second driver housing.

10. The light fixture of claim 8, wherein the bracket is U-shaped and comprises a bottom side, a first lateral side, and a second lateral side, and wherein the first driver housing is coupled to the first lateral side and the second driver housing is coupled to the second lateral side.

11. The light fixture of claim 10, wherein the bracket is coupled to the body and the body is coupled to the light fixture housing in order to couple the first driver housing and the second driver housing to the light fixture housing.

12. The light fixture of claim 11, wherein the body defines a plurality of cooling fins extending radially around the longitudinal axis, and wherein the bracket is thermally coupled to the body in order for the plurality of cooling fins to dissipate heat generated by the external power driver and the backup power driver.

13. The light fixture of claim 8, wherein the light fixture housing is cylindrical, and wherein the first driver housing and the second driver housing are positioned on opposite sides of the longitudinal axis.

14. The light fixture of claim 13, wherein the first driver housing and the second driver housing are positioned at distances on the opposite sides of the longitudinal axis such that moments perpendicular to the longitudinal axis generated by the first driver housing and the second driver housing are equal.

15. The light fixture of claim 13, wherein the light fixture is a pendant light fixture configured for the cylindrical light fixture housing to be suspended from a ceiling of a building so that the external power driver, backup power driver, backup power supply, and one or more light engines are positioned below the ceiling.

16. The light fixture of claim 8, wherein the first driver housing and the second driver housing are rectangular prism in shape.

17. The light fixture of claim 1, further comprising wiring configured for connecting the external power driver and the backup power driver to the external power source.

18. The light fixture of claim 17, further comprising control wiring configured for connecting an external lighting control system to the external power driver in order for the external power to control the one or more light engines.

19. The light fixture of claim 18, wherein the external power driver and the backup power are only connected externally to the external power source and the external lighting control system.

20. A light fixture comprising:

a light fixture housing defining an internal cavity and extending along a longitudinal axis, wherein at least one rib extends from the light fixture housing and along the light fixture housing parallel to the longitudinal axis within the internal cavity of the light fixture housing;

a light engine assembly positioned within the internal cavity of the light fixture housing and comprising one or more light engines configured to emit light for illumination and a body defining at least one slot;

one or more light engines positioned within the internal cavity of the light fixture housing and configured to emit light for illumination;

an external power driver positioned within the internal cavity of the light fixture housing and configured to receive power from an external power source, and provide power to and control the one or more light engines;

a backup power supply positioned within the internal cavity of the light fixture housing; and a backup power driver positioned within the internal cavity of the light fixture housing and configured to receive power from the backup power supply, and provide power to and control the one or more light engines, wherein the at least one rib is positioned within the at least one slot to couple the light engine assembly to the light fixture housing.

21. A light fixture comprising:

a light fixture housing defining an internal cavity and a longitudinal axis;

one or more light engines positioned within the internal cavity of the light fixture housing and configured to emit light for illumination;

a first driver housing positioned within the internal cavity of the light fixture housing, the first driver housing comprising a width and a length;

an external power driver positioned within the first driver housing and configured to receive power from an external power source and to provide power to and control the one or more light engines;

a second driver housing positioned within the internal cavity of the light fixture housing, the second driver housing comprising a width and a length;

a backup power supply positioned within the second driver housing;

a backup power driver positioned within the second driver housing and configured to receive power from the backup power supply and to provide power to and control the one or more light engines; and a bracket positioned within the internal cavity of the light fixture housing and configured to support the first driver housing and the second driver housing.

22. The light fixture of claim 21, wherein the bracket comprises a bottom side, a first lateral side, and a second lateral side.

23. The light fixture of claim 22, wherein the first driver housing is positioned on an inwardly facing surface of the first lateral side and the second driver housing is positioned on an inwardly facing surface of the second lateral side so as to face the first driver housing.

24. The light fixture of claim 22, wherein the bracket comprises a U-shaped first bracket comprising a bottom side, a first lateral side, and a second lateral side and a L-shaped second bracket, wherein the first driver housing is positioned on an inwardly facing surface of the first lateral side, wherein the second driver housing is positioned on an inwardly facing surface of the second lateral side so as to face the first driver housing, and wherein the L-shaped second bracket is interposed between the first driver housing and the second driver housing.

25. The light fixture of claim 21, wherein the length of the first driver housing is greater than the width of the first driver housing, wherein the length of the second driver housing is greater than the width of the second driver housing, and wherein the bracket is configured to position the first driver housing and the second driver housing such that the length of each of the first driver housing and the second driver housing extends substantially parallel to the longitudinal axis of the light fixture housing.

26. The light fixture of claim 21, wherein, when the bracket is positioned within the internal cavity of the light fixture housing, the first driver housing and the second driver housing are located on opposites sides of a plane extending through and along the longitudinal axis of the light fixture housing.

* * * * *